US011946359B2

(12) United States Patent
Adewuya

(10) Patent No.: US 11,946,359 B2
(45) Date of Patent: Apr. 2, 2024

(54) CEMENT SLURRY MARKER FOR IDENTIFYING FLOW SOURCES AND IMPAIRED BARRIERS

(71) Applicant: Saudi Arabian Oil Company, Dhahran (SA)

(72) Inventor: Opeyemi Adewuya, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/882,719

(22) Filed: Aug. 8, 2022

(65) Prior Publication Data

US 2024/0044243 A1 Feb. 8, 2024

(51) Int. Cl.
*E21B 47/11* (2012.01)
*E21B 47/005* (2012.01)

(52) U.S. Cl.
CPC ..... *E21B 47/005* (2020.05); *E21B 47/11* (2020.05)

(58) Field of Classification Search
CPC ..... E21B 47/005
See application file for complete search history.

(56) References Cited

U.S. PATENT DOCUMENTS 3,117,882 A 1/1964 Herschler et al.
4,391,329 A 7/1983 Gallus
5,324,356 A 6/1994 Goodwin
5,783,822 A 7/1998 Buchanan et al.
6,274,381 B1 8/2001 Pauls et al.
8,596,354 B2 12/2013 Hartshorne et al.
8,674,290 B2 3/2014 Masnyk et al.
9,976,383 B2 5/2018 Gordon et al.
10,947,438 B2 3/2021 Contreras
10,961,445 B2 3/2021 Ogle et al.
2011/0024115 A1* 2/2011 Brice ..... C09K 8/508 166/294
2011/0186290 A1* 8/2011 Roddy ..... E21B 47/09 166/253.1
2011/0252878 A1* 10/2011 Snider ..... E21B 47/11 73/152.29
2018/0142544 A1* 5/2018 Kolchanov ..... E21B 47/005

* cited by examiner

*Primary Examiner* — Silvana C Runyan
(74) *Attorney, Agent, or Firm* — Bracewell LLP; Constance G. Rhebergen; Eleanor T. Porter

(57) ABSTRACT

Methods and systems for identifying a fluid flow path in a subterranean development includes delivering a first cement slurry having a first slurry marker into an annular space, forming a first cement column at an elevation of a first reservoir layer. A second cement slurry with a second slurry marker is delivered into the annular space, forming a second cement column at an elevation of a second reservoir layer. The well casing, second cement column, and second reservoir layer is perforated and an initial fluids is produced. An initial amount of the first and second slurry markers initial fluids is measured. A packer is positioned across an inner bore of the well casing. The well casing, first cement column, and first reservoir layer is perforated and a subsequent fluids is produced. A subsequent amount of the first and second slurry markers in the subsequent fluids is measured.

13 Claims, 4 Drawing Sheets

CEMENT SLURRY MARKER FOR IDENTIFYING FLOW SOURCES AND IMPAIRED BARRIERS

BACKGROUND OF THE DISCLOSURE

1. Field of the Disclosure

The disclosure relates generally to cementing systems for use in subterranean wells, and in particular, to systems and methods for including markers in cement slurries for later identification.

2. Description of the Related Art

To assess and prove the potential of a wellbore pay-zone, reservoir quality, or flow performance of a reservoir, a well test involving the flowback of hydrocarbons from specific zones is undertaken. The results of such a well test can be used to obtaining a booking of the discovered reserves. The placement of cement in the annulus around the production casing across the interval in which the pay zone is located is critical for the successful performance of such a well test.

The correct placement of the cement is even more critical when the target zone is bounded by other fluids, such as water, gas, or oil. Significant effort is put into the cement placement program for effective isolation or separation of each target interval. An initial assessment of the effectiveness of the cement placement is carried out by running diagnostic logs, such as cement bond logs, variable density logs, or ultrasonic image logs.

Log interpretation specialists judge the integrity or assess ability of the cement column to provide isolation and ensure flow from the target reservoir exclusively comes from the reservoir and not comingled or influenced by fluids from other sources. When the cement placement or integrity is depicted as poor to fair or the prevalence of microchannels and defective cement bond are observed from the diagnostic logs, a decision is made either not to proceed with the well test or to proceed with an uncertain expectation of achieving well test results, especially if fluids from test intervals are to be produced and the flow performance is to be assessed independently.

SUMMARY OF THE DISCLOSURE

When the decision to flow the well is made, notwithstanding the cement placement quality assessed by the diagnostic logs, embodiments of the current application provide a marker or dye incorporated into the cement slurry that is released into the produced fluids at it flows past and in contact with the cement in the annulus between the casing and formation or other rock.

The existence of microchannels, poor cement-to-pipe or cement-to-rock bonds do not necessarily mean cement isolation function or effectiveness is impaired. In embodiments of this disclosure, the use of a marker in the cement at slurry partitions will confirm if produced fluids are flowing past the cement tagged by the marker device. In addition, if commingled flow is suspected or communication between two test intervals is inferred from flow behavior, the marker dyes in the produced fluids, identified in accordance with embodiments of this disclosure, can be used to obtain resolution of the presumed mixing or independent flow of the produced fluids and status of the cement isolation.

Embodiments disclosed herein provide systems and methods for including marker dyes in the cement slurry placed across target test intervals so that hydrocarbons or fluids that flow past the cement are tagged and the origin of the produced fluids can be pinpointed.

In an embodiment of this disclosure a method for identifying a fluid flow path in a subterranean development includes delivering a first cement slurry having a first slurry marker into an annular space, the first cement slurry setting to form a first cement column at an elevation of a first reservoir layer. The annular space is defined by an outer diameter surface of a well casing and an inner diameter surface of a wellbore. A second cement slurry with a second slurry marker is delivered into the annular space. The second cement slurry sets to form a second cement column at an elevation of a second reservoir layer. The second reservoir layer is downhole of the first reservoir layer. The method further includes perforating through the well casing and the second cement column and into the second reservoir layer and producing an initial fluids to a surface system. An initial amount of the second slurry marker and an initial amount of the first slurry marker in the initial fluids is measured. A packer is positioned across an inner bore of the well casing. The packer prevents fluid from traveling within the inner bore past the packer. The method further includes perforating through the well casing and the first cement column and into the first reservoir layer and producing a subsequent fluids to the surface system. A subsequent amount of the second slurry marker and a subsequent amount of the first slurry marker in the subsequent fluids is measured.

In alternate embodiments, measuring the initial amount of the second slurry marker and the initial amount of the first slurry marker in the initial fluids can include confirming that the initial amount of the first slurry marker is none, verifying that the initial fluids originated from the second reservoir layer. Measuring the subsequent amount of the second slurry marker and the subsequent amount of the first slurry marker in the subsequent fluids can include confirming that the subsequent amount of the second slurry marker is none, verifying that the subsequent fluids originated from the first reservoir layer.

In other alternate embodiments, the first cement column can extend from a downhole extent of the first reservoir layer to an uphole extent of the first reservoir layer. The second cement column extends from a downhole extent of the second reservoir layer to an uphole extent of the second reservoir layer. The first slurry marker and the second slurry marker can be a dye. The dye can be one selected from a group consisting of an anthraquinone dye, a diazo dye, and a combination of such dyes. The method can further include delivering an additional cement slurry having an additional slurry marker into the annular space, the additional cement slurry setting to form an additional cement column at an elevation of an additional reservoir layer.

In yet other alternate embodiments, the first slurry marker can be released into a produced fluid as the produced fluid flows through a cement column, where the produced fluid can be one of the initial fluids and the subsequent fluids, and where the cement column can be one of the first cement column and the second cement column. The second slurry marker can be released into a produced fluid as the produced fluid flows through a cement column, where the produced fluid can be one of the initial fluids and the subsequent fluids, and where the cement column can be one of the first cement column and the second cement column.

In still other alternate embodiments, the first reservoir layer can be spaced apart from the second reservoir layer and an intermediate rock layer can be located between the first reservoir layer and the second reservoir layer. Positioning the packer across the inner bore of the well casing can include positioning the packer at an elevation of the intermediate rock layer.

In another embodiment of this disclosure, a system for identifying a fluid flow path in a subterranean development includes a first cement slurry having a first slurry marker set to form a first cement column within an annular space at an elevation of a first reservoir layer. The annular space is defined by an outer diameter surface of a well casing and an inner diameter surface of a wellbore. A second cement slurry with a second slurry marker set to form a second cement column within the annular space at an elevation of a second reservoir layer. The second reservoir layer is downhole of the first reservoir layer. Second perforations extending through the well casing and the second cement column and into the second reservoir layer. The second perforations are operable to produce an initial fluids to a surface system, where the surface system is operable to measure an initial amount of a second slurry marker and an initial amount of a first slurry marker in the initial fluids. A packer is positioned across an inner bore of the well casing. The packer seals across the inner bore of the well casing. First perforations extend through the well casing and the first cement column and into the first reservoir layer. The first perforations are operable to produce a subsequent fluids to the surface system. The surface system is further operable to measure a subsequent amount of the second slurry marker and a subsequent amount of the first slurry marker in the subsequent fluids.

In alternate embodiments, the first cement column can extend from a downhole extent of the first reservoir layer to an uphole extent of the first reservoir layer. The second cement column can extend from a downhole extent of the second reservoir layer to an uphole extent of the second reservoir layer. The first slurry marker and the second slurry marker can be a dye. The dye can be one selected from a group consisting of an anthraquinone dye, a diazo dye, and a combination of such dyes.

In other alternate embodiments, the first slurry marker can be released into a produced fluid as the produced fluid flows through a cement column, where the produced fluid can be one of the initial fluids and the subsequent fluids, and where the cement column can be one of the first cement column and the second cement column. The second slurry marker can be released into a produced fluid as the produced fluid flows through a cement column, where the produced fluid can be one of the initial fluids and the subsequent fluids, and where the cement column can be one of the first cement column and the second cement column. The first reservoir layer can be spaced apart from the second reservoir layer and an intermediate rock layer can be located between the first reservoir layer and the second reservoir layer. The packer can be positioned across the inner bore of the well casing at an elevation of the intermediate rock layer.

In other alternate embodiments, the surface system can be operable to measure the initial amount of the second slurry marker and the initial amount of the first slurry marker in the initial fluids to confirm that the initial amount of the first slurry marker is none, verifying that the initial fluids originated from the second reservoir layer. The surface system can be operable to measure the subsequent amount of the second slurry marker and the subsequent amount of the first slurry marker in the subsequent fluids to confirm that the subsequent amount of the second slurry marker is none, verifying that the subsequent fluids originated from the first reservoir layer.

BRIEF DESCRIPTION OF THE DRAWINGS

So that the manner in which the above-recited features, aspects, and advantages of the embodiments of this disclosure, as well as others that will become apparent, are attained and can be understood in detail, a more particular description of the disclosure briefly summarized above may be had by reference to the embodiments thereof that are illustrated in the drawings that form a part of this specification. It is to be noted, however, that the appended drawings illustrate only preferred embodiments of the disclosure and are, therefore, not to be considered limiting of the disclosure's scope, for the disclosure may admit to other equally effective embodiments.

DETAILED DESCRIPTION

Embodiments of the present disclosure will now be described more fully hereinafter with reference to the accompanying drawings, which illustrate embodiments of the disclosure. Systems and methods of this disclosure may, however, be embodied in many different forms and should not be construed as limited to the illustrated embodiments set forth herein. Rather, these embodiments are provided so that this disclosure will be thorough and complete, and will fully convey the scope of the disclosure to those skilled in the art. Like numbers refer to like elements throughout, and the prime notation, if used, indicates similar elements in alternative embodiments or positions.

In the following discussion, numerous specific details are set forth to provide a thorough understanding of the present disclosure. However, it will be obvious to those skilled in the art that embodiments of the present disclosure can be practiced without such specific details. Additionally, for the most part, details concerning well drilling, reservoir testing, well completion and the like have been omitted inasmuch as such details are not considered necessary to obtain a complete understanding of the present disclosure, and are considered to be within the skills of persons skilled in the relevant art.

Figure 1:
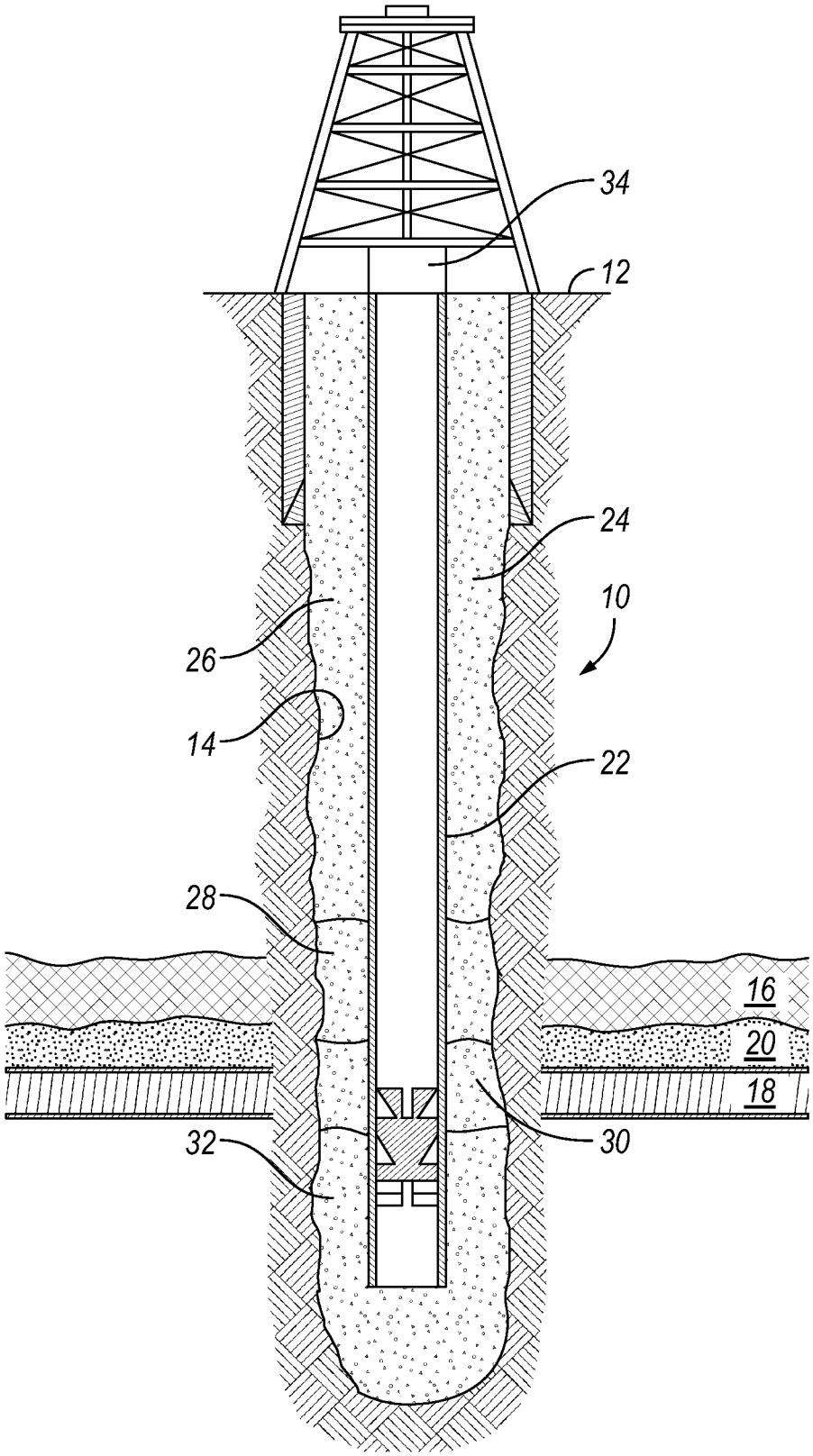
FIG. 1 is a schematic section elevation view of a subterranean well with a system for identifying a fluid flow path in a subterranean development, in accordance with an embodiment of this disclosure.

Looking at FIG. 1, subterranean well 10 extends downwards from a surface of the earth 12, which can be a ground level surface or a subsea surface. Wellbore 14 of subterranean well 10 can extended generally vertically relative to the surface. Wellbore 14 can alternately include portions that extend generally horizontally or in other directions that deviate from generally vertically from the surface. Subterranean well 10 can be a well associated with hydrocarbon development operations.

Wellbore 14 can extend through two or more reservoir layers. In the example embodiment of FIG. 1, wellbore 14 extends through first reservoir layer 16, which is an upper reservoir. Wellbore 14 further extends through second reservoir layer 18, which is a lower reservoir. First reservoir layer 16 is spaced apart from second reservoir layer 18 and an intermediate rock layer 20 is located between first reservoir layer 16 and second reservoir layer 18. Although two reservoir layers are shown in example embodiments, in alternate embodiments, wellbore 14 can extend through more than two reservoir layers, so that wellbore 14 extends through first reservoir layer 16, second reservoir layer 18, and one or more additional reservoir layers.

Well casing 22 extends into wellbore 14 of subterranean well 10. In order to secure well casing 22 within wellbore 14, cement column 24 can be set within annular space 26. Annular space 26 is defined between an outer diameter surface of well casing 22 and an inner diameter surface of wellbore 14. Sufficient cement is injected into subterranean well 10 to fill the entire annular space 26.

Cement column 24 can include a lead cement that can first be delivered into wellbore 14 as a lead cement slurry. A first tail cement slurry can then be delivered as into wellbore 14 as a first cement slurry having a first slurry marker. The first cement slurry will set to form first cement column 28 at an elevation of first reservoir layer 16. A second tail cement slurry can then be delivered into wellbore 14 as a second cement slurry having a second slurry marker. The second cement slurry will set to form a second cement column 30 at an elevation of second reservoir layer 18. A final tail cement 32 can then be delivered into wellbore 14 to complete the cementing of annular space 26.

In order to deliver the cement slurry, each component of cement column 24 can be injected though the central bore of well casing 22. The cement slurries can exit a downhole end of well casing 22 and move in an uphole direction within annular space 26. A wiper plug assembly can be delivered into the bore of well casing 22 and forced downhole after the final tail cement 32 to help push the cement out of the downhole end of well casing 22. Surface system 34 can manage the flow of fluids into and out of wellbore 14.

Each of the components of the cement slurry are delivered into well casing 22 in predetermined volumes to ensure that the cement layers set in the desired elevational locations within annular space 26. As an example, the amount of each type of cement slurry is selected so that when the cement slurries set within annular space 26, first cement column 28 extends from a downhole extent of first reservoir layer 16 to an uphole extent of first reservoir layer 16. The amount of each type of cement slurry is further selected so that when the cement slurries set within annular space 26, second cement column 30 extends from a downhole extent of second reservoir layer 18 to an uphole extent of second reservoir layer 18.

Before the first cement slurry and the second cement slurry is delivered into well casing 22, a tagging device or marker is added. As an example, a visible dye, colorant, or other marker can be added to the slurries so that first cement column 28 and second cement column 30 contain a slurry marker. The first cement slurry and the second cement slurry will contain different markers so that the first cement slurry can be distinguished from the second cement slurry.

In embodiments where there are more than two reservoir layers, each additional reservoir layer will be associated with an additional cement slurry that is set within annular space 26 and extends from a downhole extent to an uphole extent of such additional reservoir layer. Each additional cement slurry will be provided with a separate unique marker so that each cement slurry can be distinguished from any other cement slurry.

Figure 2:
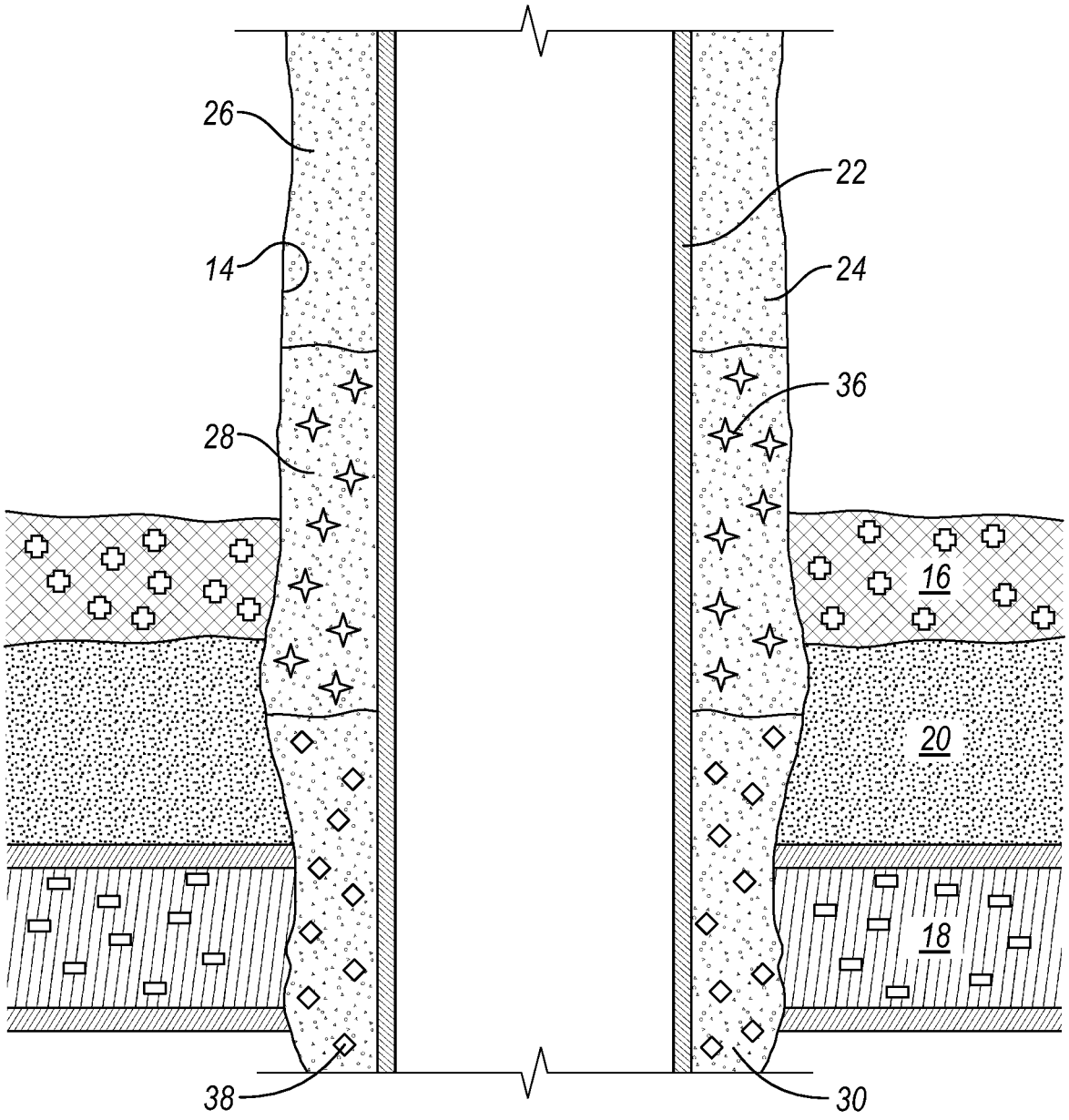
FIG. 2 is a detailed schematic section elevation view of a subterranean well with a system for identifying a fluid flow path in a subterranean development, in accordance with an embodiment of this disclosure, shown before a well casing is perforated.

Looking at FIG. 2, first reservoir layer 16 can include first slurry marker 36 and second reservoir layer 18 can include second slurry marker 38. In certain embodiments, first slurry marker 36 and second slurry marker 38 can be different dyes. In such an embodiment, first slurry marker 36 is a different dye than second slurry marker 38. In alternate embodiments, first slurry marker 36 can be an anthraquinone dye, a diazo dye, and a combination of such dyes. In other alternate embodiments, second slurry marker 38 can be an anthraquinone dye, a diazo dye, and a combination of such dyes.

Figure 3:
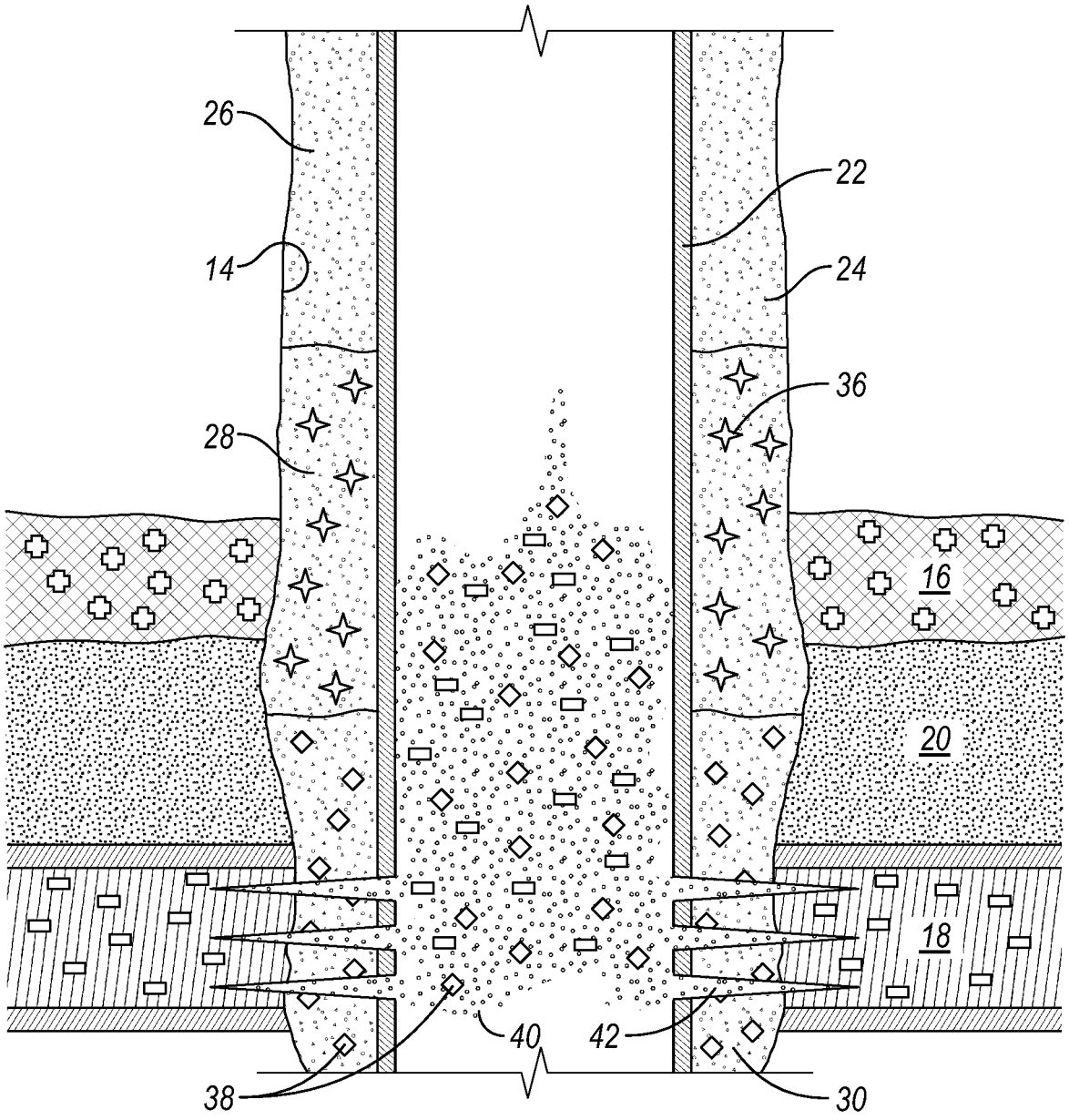
FIG. 3 is a detailed schematic section elevation view of a subterranean well with a system for identifying a fluid flow path in a subterranean development, in accordance with an embodiment of this disclosure, shown with perforations into a lower second reservoir layer.

After cement column 24 has set, well test operations can be performed. The well test operations can include perforating well casing 22 across the first target interval, which is at the elevation of lower or second reservoir layer 18. Looking at FIG. 3, the well test operation can include perforating through well casing 22 and second cement column 30 and into second reservoir layer 18 and producing an initial fluids 40 to surface system 34 (FIG. 1).

Second perforations 42 provide channels through well casing 22 and second cement column 30 so that initial fluids 40 can flow into the bore of well casing to be recovered to the surface. As initial fluids 40 flow past second cement column 30 into the bore of well casing 22, second slurry marker 38 is released and picked up by initial fluids 40 and made part of initial fluids 40.

When initial fluids 40 reaches surface system 34 (FIG. 1), an initial amount of second slurry marker 38 and an initial amount of first slurry marker 36 in initial fluids 40 is measured. The presence of any initial amount of second slurry marker 38 and the initial amount of first slurry marker 36 and the quantity of the initial amount of second slurry marker 38 and the initial amount of first slurry marker 36 can both be determined with surface system 34.

The method for detecting and measuring the initial amount of second slurry marker 38 and the initial amount of first slurry marker 36 within initial fluids 40 will be dependent on the type of tagging or marker used as the second slurry marker 38 and the first slurry marker 36.

In an example embodiment, first slurry marker 36 and second slurry marker 38 can be visible dyes that have an absorption maximum at different wavelengths from each other so that they can be separately detected. By exposing the first slurry marker 36 and second slurry marker 38 to visible radiation, the presence and quantity of first slurry marker 36 and second slurry marker 38 can be measured. The measurement can be undertaken by, for example, detecting a light absorption spectra of the first slurry marker 36 and second slurry marker 38 or detecting the emitted fluorescent light of the first slurry marker 36 and second slurry marker 38.

In measuring the initial amount of first slurry marker 36 and the initial amount of second slurry marker 38, an operator can confirm that the initial amount of the first slurry marker 36 is none. That is, only an initial amount of second slurry marker 38 is present in initial fluids 40. This can confirm that initial fluids 40 originated from second reservoir layer 18.

Confirming that initial fluids 40 originated from second reservoir layer 18 will allow the operator to determine certain reservoir characteristics of second reservoir layer 18 from the flow performance of initial fluids 40. An operator can have a level of certainty that the performance characteristics and fluid properties of initial fluids 40 reflect the reservoir characteristics of second reservoir layer 18.

Confirming that initial fluids 40 originated from second reservoir layer 18 will also confirm a certain amount of integrity of the cementing operation, such as the lack of microchannels of a defect cement bond that would allow fluids from first reservoir layer 16 to be produced through first cement column 28 and out of second perforations 42.

Figure 4:
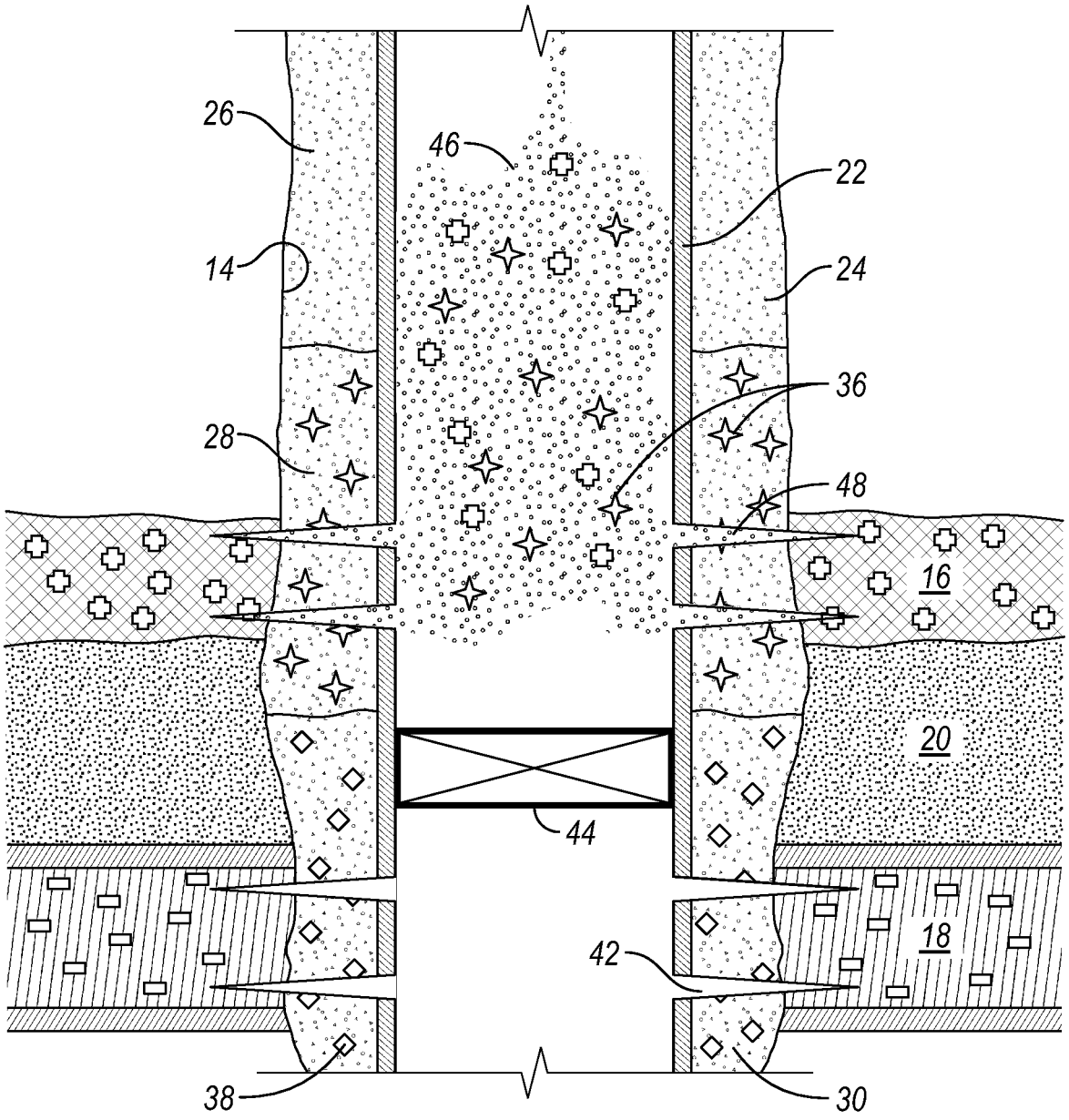
FIG. 4 is a detailed schematic section elevation view of a subterranean well with a system for identifying a fluid flow path in a subterranean development, in accordance with an embodiment of this disclosure, shown with perforations into both an upper first and a lower second reservoir layer.

Looking at FIG. 4, upon completion of the flow tests of initial fluids 40 that were produced through second perforations 42, packer 44 is positioned across the inner bore of well casing 22. Packer 44 seals across the inner bore of well casing 22, preventing fluid from traveling within the inner bore of well casing 22 past packer 44. Packer 44 will prevent any fluids that are produced through second perforations 42 from being produced to the surface.

After placing packer 44, the well test operation can continue by perforating through well casing 22 and first cement column 28 and into first reservoir layer 16 and producing subsequent fluids 46 to surface system 34 (FIG. 1). Packer 44 can be set within the inner bore of the well casing 22 at an elevation of intermediate rock layer 20.

First perforations 48 provide channels through well casing 22 and first cement column 28 so that subsequent fluids 46 can flow into the bore of well casing to be recovered to the surface. As subsequent fluids 46 flow past first cement column 28 into the bore of well casing 22, first slurry marker 36 is released and picked up by subsequent fluids 46 and made part of subsequent fluids 46.

When subsequent fluids 46 reaches surface system 34 (FIG. 1), a subsequent amount of second slurry marker 38 and a subsequent amount of first slurry marker 36 in subsequent fluids 46 is measured. The presence of any subsequent amount of second slurry marker 38 and subsequent amount of first slurry marker 36 and the quantity of the subsequent amount of second slurry marker 38 and the subsequent amount of first slurry marker 36 can both be determined with surface system 34.

The method for detecting and measuring the subsequent amount of second slurry marker 38 and the subsequent amount of first slurry marker 36 within subsequent fluids 46 will be dependent on the type of tagging or marker used as the second slurry marker 38 and the first slurry marker 36.

As noted, first slurry marker 36 and second slurry marker 38 can be visible dyes that have an absorption maximum at different wavelengths from each other so that they can be separately detected. By exposing the first slurry marker 36 and second slurry marker 38 to visible radiation, the presence and quantity of first slurry marker 36 and second slurry marker 38 can be measured. The measurement can be undertaken by, for example, detecting a light absorption spectra of the first slurry marker 36 and second slurry marker 38 or detecting the emitted fluorescent light of the first slurry marker 36 and second slurry marker 38.

In measuring the subsequent amount of first slurry marker 36 and the subsequent amount of second slurry marker 38, an operator can confirm that the subsequent amount of the second slurry marker 38 is none. That is, only a subsequent amount of first slurry marker 36 is present in subsequent fluids 46. This can confirm that subsequent fluids 46 originated from first reservoir layer 16.

Confirming that subsequent fluids 46 originated from first reservoir layer 16 only will allow the operator to determine certain reservoir characteristics of first reservoir layer 16 from the flow performance of subsequent fluids 46. An operator can have a level of certainty that the performance characteristics and fluid properties of subsequent fluids 46 reflect the reservoir characteristics of first reservoir layer 16.

Confirming that subsequent fluids 46 originated from first reservoir layer 16 will also confirm a certain amount of integrity of the cementing operation, such as the lack of microchannels of a defect cement bond that would allow fluids from second reservoir layer 18 to be produced through second cement column 30 and out of first perforations 48.

In embodiments where there are more than two reservoir layers, such process of placing a packer, and perforating to provide channels through well casing 22 and any additional cement column so that additional fluids can flow into the bore of well casing to be recovered to the surface can be repeated as needed. The additional fluids that are recovered at the surface can be evaluated to identify any slurry markers to confirm the origination of such additional fluids.

Embodiments of this disclosure therefore provide systems and methods for assessing the condition of the set casing by determining if there is any commingling of the flow of fluids from separated reservoirs. Additionally, cement isolation quality assessed from cement bond logs can be further validated, by confirming the existence of connectivity between discerned microchannels that appear or are interpretations of the diagnostic logs. These interpretations of cement column defects are often wrong and the basis of costly decisions to undertake remedial work.

Systems and methods described herein provide the ability to prove that reservoir fluids are coming from individual reservoir members and that the flow performance is therefore unique to a single reservoir. The implication of the confirmation of the origin of produced fluids is increasing the level of confidence in the reservoir parameters for booking reserves from independent reservoir performance.

Embodiments of the disclosure described herein, therefore, are well adapted to carry out the objects and attain the ends and advantages mentioned, as well as others inherent therein. While a presently preferred embodiment of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A method for identifying a fluid flow path in a subterranean development, the method including:

delivering a first cement slurry having a first slurry marker into an annular space, the first cement slurry setting to form a first cement column at an elevation of a first reservoir layer, where the annular space is defined by an outer diameter surface of a well casing and an inner diameter surface of a wellbore, where the first slurry marker is a dye selected from a group consisting of an anthraquinone dye, a diazo dye, and a combination of such dyes;

delivering a second cement slurry with a second slurry marker into the annular space, the second cement slurry setting to form a second cement column at an elevation of a second reservoir layer, where the second reservoir layer is downhole of the first reservoir layer, where the second slurry marker is a dye selected from a group consisting of an anthraquinone dye, a diazo dye, and a combination of such dyes, wherein the second slurry marker is different from the first slurry marker;

perforating through the well casing and the second cement column and into the second reservoir layer and producing an initial fluids to a surface system;

measuring an initial amount of the second slurry marker and an initial amount of the first slurry marker in the initial fluids;

positioning a packer across an inner bore of the well casing, the packer preventing fluid from traveling within the inner bore past the packer;

perforating through the well casing and the first cement column and into the first reservoir layer and producing a subsequent fluids to the surface system; and measuring a subsequent amount of the second slurry marker and a subsequent amount of the first slurry marker in the subsequent fluids, where the first slurry marker and the second slurry marker are released into a produced fluid as the produced fluid flows through a cement column, where the produced fluid is one of the initial fluids and the subsequent fluids, and where the cement column is one of the first cement column and the second cement column.

2. The method of claim 1, where measuring the initial amount of the second slurry marker and the initial amount of the first slurry marker in the initial fluids includes confirming that the initial amount of the first slurry marker is none, verifying that the initial fluids originated from the second reservoir layer.

3. The method of claim 1, where measuring the subsequent amount of the second slurry marker and the subsequent amount of the first slurry marker in the subsequent fluids includes confirming that the subsequent amount of the second slurry marker is none, verifying that the subsequent fluids originated from the first reservoir layer.

4. The method of claim 1, where the first cement column extends from a downhole extent of the first reservoir layer to an uphole extent of the first reservoir layer.

5. The method of claim 1, where the second cement column extends from a downhole extent of the second reservoir layer to an uphole extent of the second reservoir layer.

6. The method of claim 1, where the method further includes delivering an additional cement slurry having an additional slurry marker into the annular space, the additional cement slurry setting to form an additional cement column at an elevation of an additional reservoir layer.

7. The method of claim 1, where the first reservoir layer is spaced apart from the second reservoir layer and an intermediate rock layer is located between the first reservoir layer and the second reservoir layer, and where positioning the packer across the inner bore of the well casing includes positioning the packer at an elevation of the intermediate rock layer.

8. A system for identifying a fluid flow path in a subterranean development, the system including:

a first cement slurry having a first slurry marker set to form a first cement column within an annular space at an elevation of a first reservoir layer, where the annular space is defined by an outer diameter surface of a well casing and an inner diameter surface of a wellbore, where the first slurry marker is a dye selected from a group consisting of an anthraquinone dye, a diazo dye, and a combination of such dyes;

a second cement slurry with a second slurry marker set to form a second cement column within the annular space at an elevation of a second reservoir layer, where the second reservoir layer is downhole of the first reservoir layer, where the second slurry marker is a dye selected from a group consisting of an anthraquinone dye, a diazo dye, and a combination of such dyes, wherein the second slurry marker is different from the first slurry marker;

second perforations extending through the well casing and the second cement column and into the second reservoir layer, the second perforations operable to produce an initial fluids to a surface system, where the surface system is operable to measure an initial amount of a second slurry marker and an initial amount of a first slurry marker in the initial fluids;

a packer positioned across an inner bore of the well casing, the packer sealing across the inner bore of the well casing; and first perforations extending through the well casing and the first cement column and into the first reservoir layer, the first perforations operable to produce a subsequent fluids to the surface system, where the surface system is further operable to measure a subsequent amount of the second slurry marker and a subsequent amount of the first slurry marker in the subsequent fluids, where the first slurry marker and the second slurry marker are released into a produced fluid as the produced fluid flows through a cement column, where the produced fluid is one of the initial fluids and the subsequent fluids, and where the cement column is one of the first cement column and the second cement column.

9. The system of claim 8, where the first cement column extends from a downhole extent of the first reservoir layer to an uphole extent of the first reservoir layer.

10. The system of claim 8, where the second cement column extends from a downhole extent of the second reservoir layer to an uphole extent of the second reservoir layer.

11. The system of claim 8, where the first reservoir layer is spaced apart from the second reservoir layer and an intermediate rock layer is located between the first reservoir layer and the second reservoir layer, and where the packer is positioned across the inner bore of the well casing at an elevation of the intermediate rock layer.

12. The system of claim 8, where the surface system is operable to measure the initial amount of the second slurry marker and the initial amount of the first slurry marker in the initial fluids to confirm that the initial amount of the first slurry marker is none, verifying that the initial fluids originated from the second reservoir layer.

13. The system of claim 8, where the surface system is operable to measure the subsequent amount of the second slurry marker and the subsequent amount of the first slurry marker in the subsequent fluids to confirm that the subsequent amount of the second slurry marker is none, verifying that the subsequent fluids originated from the first reservoir layer.

* * * * *